US008944753B2

(12) United States Patent
Bouchard et al.

(10) Patent No.: US 8,944,753 B2
(45) Date of Patent: Feb. 3, 2015

(54) STRUT MOUNTING ARRANGEMENT FOR GAS TURBINE EXHAUST CASE

(75) Inventors: Richard Bouchard, Sorel-Tracy (CA); Daniel Trottier, Calixia-Lavaliée (CA); Gaetan Girard, Outremont (CA)

(73) Assignee: Pratt & Whitney Canada Corp., Longueuil, QC (CA)

( * ) Notice: Subject to any disclaimer, the term of this patent is extended or adjusted under 35 U.S.C. 154(b) by 513 days.

(21) Appl. No.: 13/292,295

(22) Filed: Nov. 9, 2011

(65) Prior Publication Data

US 2013/0115076 A1 May 9, 2013

(51) Int. Cl.
*F01D 25/28* (2006.01)
*F01D 9/06* (2006.01)

(52) U.S. Cl.
CPC . *F01D 25/28* (2013.01); *F01D 9/06* (2013.01); *F05D 2240/62* (2013.01); *F05D 2300/5021* (2013.01)
USPC ..... 415/119; 415/209.3; 415/209.4; 415/210.1

(58) Field of Classification Search
USPC ..... 415/119, 133, 140, 209.3, 209.4, 210.1
See application file for complete search history.

(56) References Cited

U.S. PATENT DOCUMENTS 2,681,788 A 6/1954 Wosika
2,928,648 A * 3/1960 Haines et al. ..... 415/138
3,028,141 A 4/1962 Nichols
3,071,346 A 1/1963 Broffitt
3,511,577 A 5/1970 Karstensen
3,730,292 A 5/1973 MacDonald
4,106,587 A 8/1978 Nash et al.
4,137,992 A 2/1979 Herman
4,226,297 A 10/1980 Cicon
4,240,252 A * 12/1980 Sargisson et al. ..... 60/262
4,384,822 A 5/1983 Schweikl et al.
4,391,565 A 7/1983 Speak
4,433,751 A 2/1984 Bonneau
4,534,700 A * 8/1985 Horler et al. ..... 415/135
4,639,189 A 1/1987 Rosman
4,756,153 A 7/1988 Roberts et al.
4,889,469 A 12/1989 Wilkinson
4,907,946 A * 3/1990 Ciokajlo et al. ..... 415/209.3
4,926,963 A 5/1990 Snyder
4,947,958 A 8/1990 Snyder
4,989,406 A 2/1991 Vdoviak et al.
5,060,471 A 10/1991 Torkelson
5,167,118 A 12/1992 Torkelson
5,269,651 A 12/1993 Ostermeir et al.
5,653,580 A 8/1997 Faulder et al.

(Continued)

OTHER PUBLICATIONS

Broszat, Dominik et al., "Validation of an Integrated Acoustic Absorber in a Turbine Exit Guide Vane", American Institute of Aeronautics and Astronautics/CEAS Aeronacoustics Conference, Jun. 5-8, 2011, Portlant Oregon, p. 1-7.

*Primary Examiner* — Liam McDowell
(74) *Attorney, Agent, or Firm* — Norton Rose Fulbright Canada LLP

(57) ABSTRACT

A turbine exhaust case comprises inner and outer annular shrouds defining therebetween an annular hot gaspath. A circumferential array of exhaust struts extends across the gaspath. The exhaust struts are mounted at one radial end thereof on a flexible strut mounting structure. The flexible strut mounting structure is radially deflectable relative to the outer and inner shrouds to accommodate thermal expansion of the exhaust struts during engine operation.

11 Claims, 3 Drawing Sheets

(56) References Cited

U.S. PATENT DOCUMENTS

| | | | | |
|---|---|---|---|---|
| 5,715,672 | A | 2/1998 | Schockemoehl et al. | |
| 6,263,998 | B1 | 7/2001 | Schockemoehl et al. | |
| 6,547,518 | B1 | 4/2003 | Czachor et al. | |
| 6,584,766 | B1 | 7/2003 | Czachor | |
| 7,000,406 | B2 | 2/2006 | Markarian et al. | |
| 7,246,995 | B2 | 7/2007 | Zborovsky | |
| 7,337,875 | B2 | 3/2008 | Proscia et al. | |
| 7,604,095 | B2 | 10/2009 | Mitchell | |
| 7,784,283 | B2 | 8/2010 | Yu et al. | |
| 7,819,224 | B2 | 10/2010 | Borchers et al. | |
| 7,836,702 | B2 | 11/2010 | Grivas et al. | |
| 7,886,543 | B2 | 2/2011 | Vincent | |
| 7,891,195 | B2 | 2/2011 | Bouty et al. | |
| 7,950,236 | B2 | 5/2011 | Durocher et al. | |
| 7,954,596 | B2 | 6/2011 | Schulze et al. | |
| 2004/0253096 | A1* | 12/2004 | Legg | 415/191 |
| 2006/0010852 | A1 | 1/2006 | Gekht et al. | |
| 2011/0036068 | A1* | 2/2011 | Lefebvre et al. | 60/262 |
| 2011/0108357 | A1 | 5/2011 | Vauchel et al. | |
| 2011/0126544 | A1 | 6/2011 | Foster | |

* cited by examiner

STRUT MOUNTING ARRANGEMENT FOR GAS TURBINE EXHAUST CASE

TECHNICAL FIELD

The application relates generally to gas turbine engines and, more particularly, to gas turbine exhaust cases.

BACKGROUND OF THE ART

Turbine exhaust cases typically comprise inner and outer annular shrouds structurally interconnected by a plurality of circumferentially spaced-apart airfoils or struts. In use, the airfoils are exposed to the hot core flow leaving the turbine section and are, thus, subject to thermal expansion. Thermal fight or thermal mismatch between the inner and outer shrouds and the airfoils may result in non-negligible stress levels throughout the exhaust case structure. The thermal fight is amplified by the fact that the inner and outer shrouds tend to be cooler than the airfoils since they are somewhat thermally protected by the developed boundary layers and are also typically exposed to cooler external flows (e.g. fan bypass flow).

Over the years various approaches have been developed to reduce the level of stress in turbine exhaust cases. However, there remains room for improvement.

SUMMARY

In one aspect, there is provided a turbine exhaust case for a gas turbine engine having an axis, the turbine exhaust case comprising a radially outer annular shroud and a radially inner annular shroud concentrically mounted about said axis and defining therebetween an annular gaspath for channelling hot gases; at least one strut support ring mounted inside said annular gaspath adjacent to and spaced apart from an associated one of said radially outer and inner annular shrouds so as to define a radial gap with the associated one of said radially outer and inner annular shrouds, said at least one strut support ring having a plurality of circumferentially spaced-part axially projecting fingers; and a plurality of circumferentially spaced-apart struts extending radially between said inner and outer annular shrouds, said struts being mounted at a first radial end thereof to said axially projecting fingers of said at least one strut support ring, said axially projecting fingers being radially deflectable into said radial gap in response to a thermal growth of said struts.

In a second aspect, there is provided a turbine exhaust case of a gas turbine engine, comprising a radially inner annular shroud mounted about an axis, a radially outer annular shroud concentrically mounted about the radially inner shroud, the radially inner and outer annular shrouds defining therebetween an annular gaspath, a circumferential array of exhaust struts extending across the gaspath, at least one radial end of said exhaust struts being mounted on a flexible strut mounting structure, said flexible strut mounting structure being radially deflectable relative to said radially outer and inner shrouds to accommodate thermal expansion of said exhaust struts during engine operation.

DESCRIPTION OF THE DRAWINGS

Reference is now made to the accompanying figures, in which.

DETAILED DESCRIPTION

Figure 1:
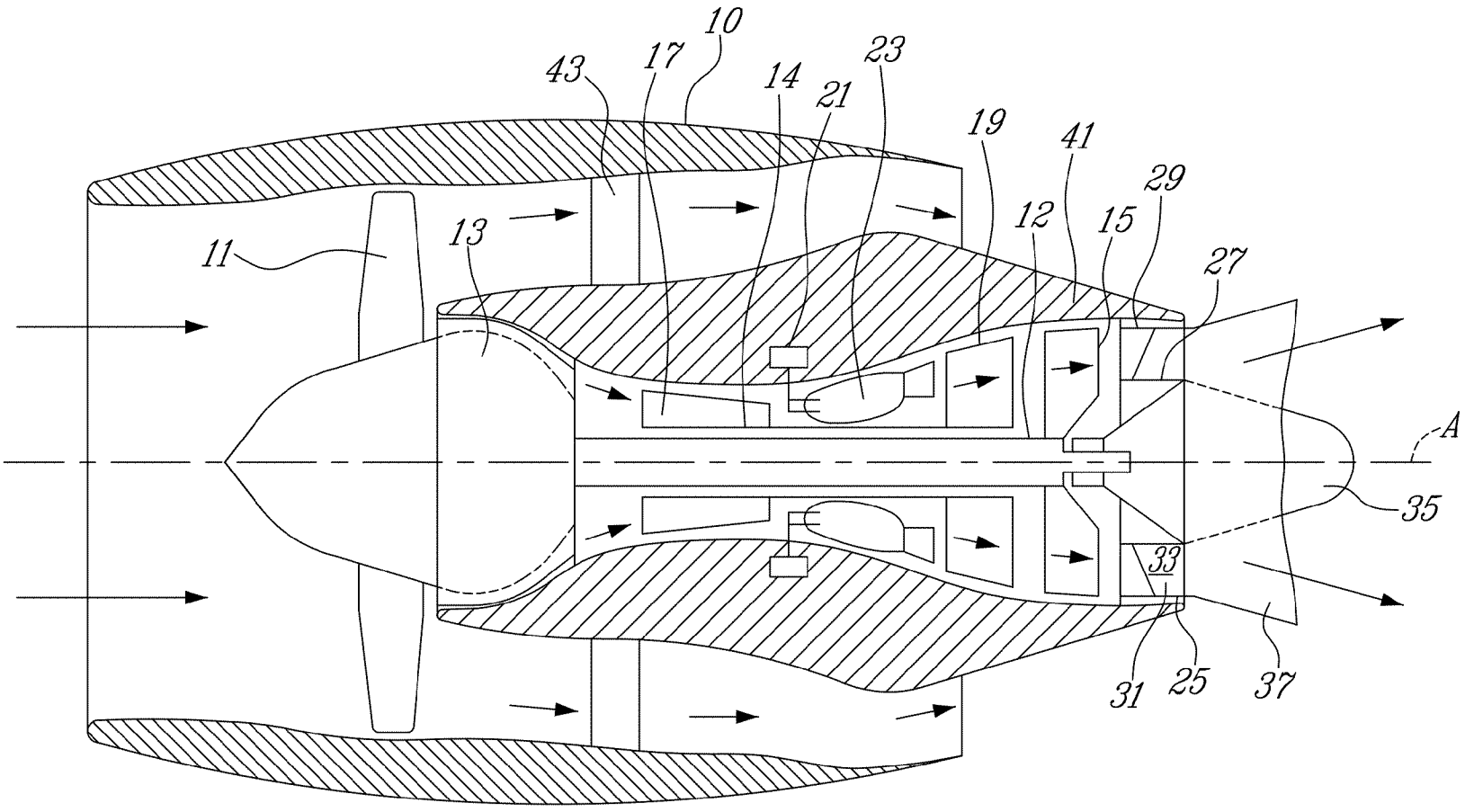
FIG. 1 is a schematic cross-section view of a turbofan gas turbine engine.

FIG. 1 illustrates an example of a turbofan gas turbine engine generally comprising a housing or nacelle 10; a low pressure spool assembly 12 including a fan 11, a low pressure compressor 13 and a low pressure turbine 15; a high pressure spool assembly 14 including a high pressure compressor 17, and a high pressure turbine 19; and a combustor 23 including fuel injecting means 21.

Figure 2B:
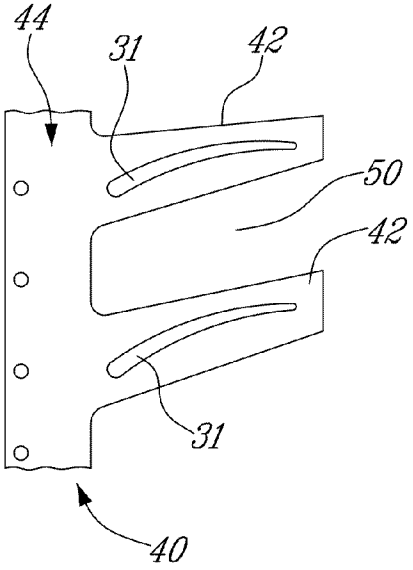
FIG. 2*b* is a cross-section view taken along line 2*b*-2*b* in FIG. 2*a;*
Figure 2A:
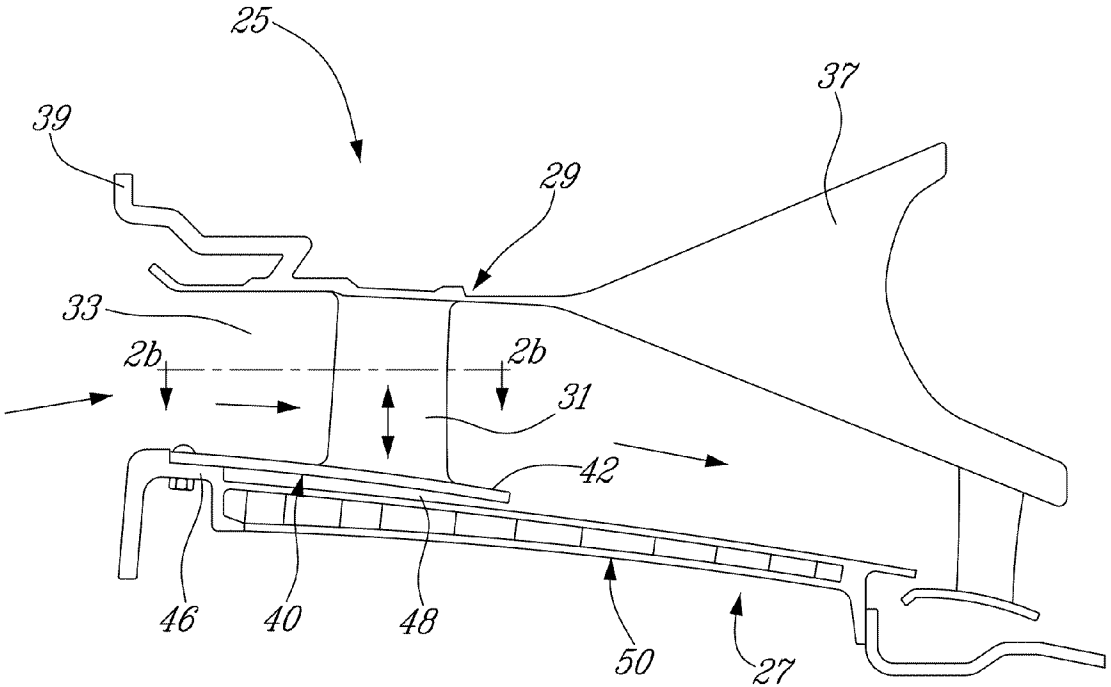
FIG. 2*a* is a schematic cross-section view of a turbine exhaust case of the engine shown in FIG. 1.
Figure 3B:
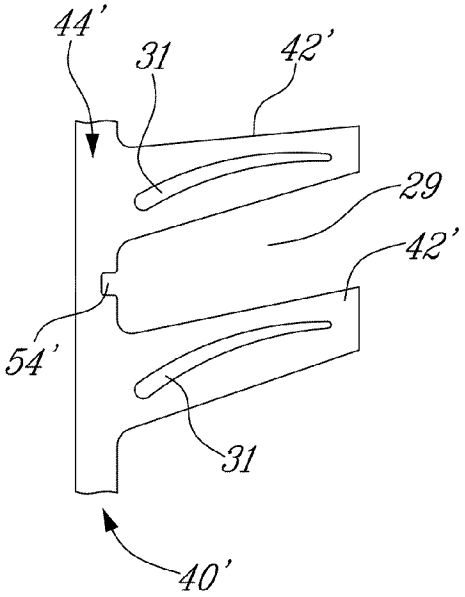
FIG. 3*b* is a cross-section view taken along line 3*b*-3*b* in FIG. 3*a.*
Figure 3A:
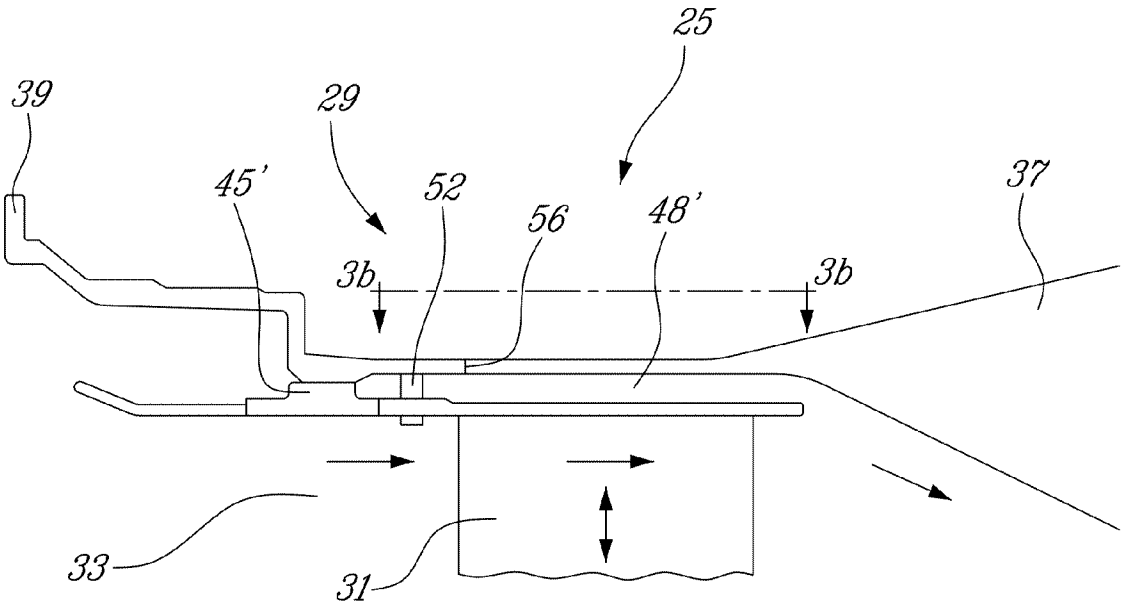
FIG. 3*a* is an enlarged cross-section view of the turbine exhaust case illustrating one possible flexible mounting arrangement of the exhaust struts to the outer shroud of the exhaust case.

Referring to FIGS. 1 to 3, the gas turbine engine further comprises a turbine exhaust case 25 disposed immediately downstream of the last stage of low pressure turbine blades for receiving hot gases from the low pressure turbine 15 and exhausting the hot gases to the atmosphere. The turbine exhaust case 25 may comprise an annular inner shroud 27 (FIG. 2*a*) concentrically mounted about the central axis A (FIG. 1) of the engine, an annular outer shroud 29 concentrically mounted about the central axis A of the engine and the inner shroud 27. The inner and outer shrouds 27, 29 define therebetween an annular gaspath 33 for channelling the engine core flow. A plurality of circumferentially spaced-apart struts 31 extends radially between the inner and outer shrouds 27, 29 across the gaspath 33. The struts 31 may not only serve as structural components, they may have an airfoil profile to serve as vanes for directing/straightening the incoming flow of hot gases. The struts 31 may also have a hollow body. A multi-lobed mixer 37 may extend axially rearwardly from the outer shroud 29. A mounting flange 39 (FIGS. 2*a* and 3*a*) may be provided at the front end of the outer shroud 29 for securing the turbine exhaust case 25 to the engine case 41 (FIG. 1) which, in turn, may be structurally connected to the nacelle 10 through a plurality struts 43 (FIG. 1) extending radially through the bypass passage of the engine. Referring more specifically to FIG. 1, it may also be appreciated that a tail cone 35 may be mounted to the aft end of the inner shroud 27 of the turbine exhaust case 25. The tail cone 35 is bolted or other suitably removably connected to the inner shroud 27.

In operation, combustion gases discharged from the combustor 23 power the high and low pressure turbines 19 and 15, and are then exhausted into the annular hot gaspath 33 defined between the inner and outer shrouds 27, 29 of the turbine exhaust case 25. The tangential components included in the exhaust gases may be de-swirled by the struts 31 or similar de-swirling airfoil structures which may be integrated in the turbine exhaust case 25, and then the exhaust gases are discharged into the atmosphere through the mixer 37 which facilitates the mixing of the exhaust gases with the outer air flow from the bypass passage.

Referring now more specifically to FIGS. 2*a* and 2*b*, it can be appreciated that the struts 31 may be mounted at an inner radial end thereof to a flexible strut mounting structure 40. As will be seen hereinafter, the structure 40 provides thermal fight relief by providing a flexible mounting of the struts 31 to the exhaust case structure 25. The flexible strut mounting structure 40 may comprise a circumferential array of generally axially extending springboard-like members or flexible fingers 42 adapted to be radially deflected in response of thermally induce movement of the struts 31. According to the illustrated embodiment, the fingers 42 are defined in the aft end portion of a sheet metal support ring 44. The support ring 44 is mounted inside the gaspath 33 adjacent to the inner shroud 27. The support ring 44 is structurally connected at a forward end portion thereof to an enlarged diameter portion 46 of the inner shroud 27. The support ring 44 may be mechanically fastened, such as by bolting, to the enlarged diameter portion 46 of the inner shroud 27. As can be appreciated from FIG. 2*a*, the support ring 44 and, thus, the fingers 42 defined therein extend axially rearwardly in a cantilever fashion from the enlarged diameter portion 44 of the inner shroud 27. The radial gap 48 between the fingers 42 and the inner shroud 27 allows accommodating the radial deflection of the fingers 42 in response to a thermal growth of the struts 31.

According to the illustrated embodiment, each finger 42 supports one strut 31. However, other configurations are contemplated as well. The struts 31 may be welded or otherwise suitably mounted on the fingers 42. As can be seen from FIG. 2*b*, the axial length of the fingers 42 is selected so as to accommodate the full axial span or chord of the struts 31. The fingers 42 may have an axially tapering profile from root to tip. The fingers 42 are slightly larger than the struts 31 in a circumferential direction. The space between adjacent fingers 42 is function of the distance between adjacent struts and of the desired finger flexibility. If an acoustic treatment is applied to the inner shroud 27, the gaps between the fingers 42 may be made as large as possible in order to maximize the exposure of the acoustic treatment.

As shown in FIG. 2*a*, the acoustic treatment may comprise an acoustic panel 50. More particularly, the inner shroud 27 may be composed of a single acoustic panel 50 or, alternatively, it can be circumferentially segmented and composed of a plurality of separate/individual arcuate acoustic panels 50 assembled into a circumferentially extending band. By forming the inner shroud 27 with acoustic panel(s) 50, the acoustic treatment can be applied substantially along the full axial length of the inner shroud 27 that is from a forward end of the exhaust turbine case 25 to an aft end thereof, thereby providing added sound attenuation as compared to conventional arrangements where the acoustic treatment is applied downstream of the turbine exhaust case 25 to the tail cone 35 or in other non-ducted exhaust areas. The acoustic panels may consist of commercially available acoustic panels of the type having a sandwich structure comprising a core layer of cellular honeycomb like material disposed between two thin metal facing sheets or skins. The support ring 44 may be mounted directly to the forward end of the acoustic panel(s) 50. The ring 44 extends axially rearwardly in an overlapping relationship with a portion of the panel(s). The support ring 42 may, thus, also act a frame member to hold the inner shroud acoustic panels 50 all together. The scallops that may be cut or otherwise suitably formed in the aft end of the support ring 44 to form the fingers 42 not only provide for a flexible mounting of the struts 31 but also allow to uncover the acoustic treatment which is underneath the support ring 42.

As shown in FIG. 2*a*, the radially outer end of each strut 31 may be welded or otherwise suitably rigidly attached to the outer shroud 29. However, as shown in FIGS. 3*a* and 3*b*, the struts 31 may be mounted at the radially outer end thereof to a second flexible mounting structure 40' similar to structure 40 provided at the radially inner end of the struts 31. The structure 40' may comprise a support ring 44' adapted to be axially fitted inside the outer shroud 29. The support ring 44' may be provided with an enlarged outer diameter at a forward end portion 45' thereof to provide a tight circumferential fit between the outer shroud 29 and the support ring 44'. Relative rotation between the outer shroud 29 and the support 44' may be prevented by a male member 52 projecting radially inwardly from the outer shroud 29 into a mating catch or groove 54' (FIG. 3*b*) defined in support ring 44'. Other anti-rotation mechanism could be used as well. Like the inner strut support ring 44, the outer strut support ring 44' is provided with rearwardly projecting fingers 42' defining a radial gap 48' with the outer shroud 29. The fingers 42' have the ability of being deflected radially outwardly into the gap 48' under the thermal expansion of the struts 31. The struts 31 may be welded or otherwise suitably mounted to the fingers 42'.

The mounting of the radially outer end of the struts 31 to an intermediate structure (namely the flexible mounting structure 40') as opposed to directly to the outer shroud 29 provides more flexibility for the designers in joining the mixer 37 to the remaining forward portion of the outer shroud 29. Indeed, previously the junction of the struts 31 with the outer shroud 29 was somewhat interfering with the joining of the mixer 37 with the outer shroud 29 at an axial location corresponding to the area where the struts 31 were attached to the outer shroud 29. Accordingly, the mixer 37 was typically attached to the outer shroud 29 at a location axially downstream of the struts 31. Now that the radially outer end of the struts 31 are mounted to the fingers 42' of the support ring 44' inside the outer shroud 29, the mixer 37 can be joined to the outer shroud 29 at a more axially forward location. According to the embodiment illustrated in FIG. 3*a*, the mixer 37 is welded to the outer shroud 29 at 56 in general alignment with the leading edge of the struts 31.

The designers may also take advantage of the gaps/free space between circumferentially adjacent fingers 42' to position thermocouples or other measuring instruments/sensors (not shown) in the gaspath 33.

The above described inner and outer flexible strut mounting structures 40 and 40' may be designed to maintain the integrity of the exhaust case 25 while providing just the right amount of flexibility to allow thermal expansion of the struts in a simple and practical way.

The above description is meant to be exemplary only, and one skilled in the art will recognize that changes may be made to the embodiments described without departing from the scope of the invention disclosed. For instance, it is understood that the flexible mounting structures may be provided at both ends of the struts or at only one of the radially outer and the radially inner end thereof. Also it is understood that individual cantilevered fingers could be separately mounted to an associated one of the inner and outer shroud. Still other modifications which fall within the scope of the present invention will be apparent to those skilled in the art, in light of a review of this disclosure, and such modifications are intended to fall within the scope of the appended claims.

What is claimed is:

1. A turbine exhaust case for a gas turbine engine having an axis, the turbine exhaust case comprising a radially outer annular shroud and a radially inner annular shroud concentrically mounted about said axis and defining therebetween an annular gaspath for channelling hot gases; at least one strut support ring mounted inside said annular gaspath adjacent to and spaced apart from an associated one of said radially outer annular shroud and said radially inner annular shroud so as to define a radial gap with the associated one of said radially outer annular shroud and said radially inner annular shroud, said at least one strut support ring having a plurality of circumferentially spaced-part axially projecting fingers; and a plurality of circumferentially spaced-apart struts extending radially between said radially inner annular shroud and said radially outer annular shroud, said struts being mounted at a first radial end thereof to said axially projecting fingers of said at least one strut support ring, said axially projecting fingers being radially deflectable into said radial gap in response to a thermal growth of said struts, said at least one strut support ring comprising a first strut support ring mounted to said radially outer annular shroud, wherein an anti-rotation mechanism is provided to retain the first strut support ring against angular movement relative to the radially outer annular shroud, said anti-rotation mechanism comprising at least on male member projecting radially inwardly from said radially outer annular shroud in engagement between two circumferentially adjacent fingers of the axially projecting fingers of the first strut support ring.

2. The turbine exhaust case defined in claim 1, wherein said at least one strut support ring is supported in a cantilever fashion by said associated one of said radially inner annular shroud and said radially outer annular shroud.

3. The turbine exhaust case defined in claim 2, wherein said at least one strut support ring is supported at only a forward end thereof, the axially projecting fingers being provided at an axially opposed aft end of the at least one support ring.

4. The turbine exhaust case defined in claim 1, wherein said at least one strut support ring is a unitary sheet metal member.

5. The turbine exhaust case defined in claim 1, wherein the struts have an axial length defined between a leading edge and a trailing edge of the struts, and wherein the axially projecting fingers have an axial length which is equal to or greater than the axial length of the struts.

6. The turbine exhaust case defined in claim 1, wherein the fingers are spaced-apart by generally axially extending cuts, said cuts exposing an acoustic treatment applied to said associated one of said radially outer annular shroud and said radially inner annular shroud.

7. The turbine exhaust case defined in claim 1, wherein each of said axially projecting fingers supports only one of said struts.

8. The turbine exhaust case defined in claim 1, wherein said struts are structurally connected at a second radial end thereof to the other one of said associated one of said radially outer annular shroud and said radially inner annular shroud.

9. The turbine exhaust case defined in claim 1, wherein said at least one strut support ring further comprises a second strut support ring supported at a forward end portion thereof by said radially inner annular shroud.

10. The turbine exhaust case defined in claim 1, wherein said associated one of said radially inner annular shroud and said radially outer annular shroud is said radially inner annular shroud, said strut support ring being mechanically fastened at a forward end thereof to said radially inner annular shroud, said fingers projecting axially rearwardly of said forward end in overlapping relationship with an acoustic treatment applied to said radially inner annular shroud, the fingers being moveable towards and away from the acoustic treatment in response to thermally induced movement of the struts.

11. The turbine exhaust case defined in claim 1, wherein said first strut support ring is circumferentially supported at a forward end thereof by said radially outer annular shroud.

* * * * *